US006457333B1

(12) United States Patent
Shelton

(10) Patent No.: US 6,457,333 B1
(45) Date of Patent: Oct. 1, 2002

(54) LATCH NEEDLE

(76) Inventor: William Ewart Alan Shelton, Gartree House, Back Lane, Gaulby, Leicestershire LE7 9LP (GB)

( * ) Notice: Subject to any disclaimer, the term of this patent is extended or adjusted under 35 U.S.C. 154(b) by 0 days.

(21) Appl. No.: 09/857,986

(22) PCT Filed: Dec. 2, 1999

(86) PCT No.: PCT/GB99/04038

§ 371 (c)(1),
(2), (4) Date: Jul. 13, 2001

(87) PCT Pub. No.: WO00/34560

PCT Pub. Date: Jun. 15, 2000

(30) Foreign Application Priority Data

Dec. 10, 1998 (GB) ..... 9827054

(51) Int. Cl.[7] ..... D04B 35/04
(52) U.S. Cl. ..... 66/121
(58) Field of Search ..... 66/116, 121, 122, 66/123

(56) References Cited

U.S. PATENT DOCUMENTS

| | | | | | |
|---|---|---|---|---|---|
| 51,115 | A | * | 11/1865 | Lamb | 66/121 |
| 189,501 | A | * | 4/1877 | Salisbury | 66/121 |
| 1,032,613 | A | * | 7/1912 | Korndoefer, Jr. | 66/121 |
| 1,831,872 | A | * | 11/1931 | Messing | 66/121 |
| 2,399,308 | A | * | 4/1946 | Amidon | 66/121 |

FOREIGN PATENT DOCUMENTS

| | | | | | |
|---|---|---|---|---|---|
| CH | 384765 | | | 2/1965 | |
| CH | 384765 | A | * | 2/1965 | 66/121 |
| DE | 1269283 | | | 3/1968 | |
| DE | 1269283 | B | * | 5/1968 | 66/121 |
| GB | 105316 | | | 4/1917 | |
| GB | 105316 | A | * | 4/1917 | 66/121 |
| GB | 380554 | | | 9/1932 | |
| GB | 380554 | A | * | 9/1932 | 66/121 |
| GB | 1160832 | A | * | 8/1969 | 66/121 |
| GB | 1160832 | | | 8/1969 | |

* cited by examiner

*Primary Examiner*—Danny Worrell
(74) *Attorney, Agent, or Firm*—Young & Basile, P.C.

(57) ABSTRACT

A latch needle comprises a hook, a stem and a latch. The latch is pivotally mounted to the stem for rotation between two positions in the first of which the latch is located within the hook and in the second of which the latch is located external of the hook. The latch spoon is notched at its tip to permit the latch to pass either side of the point of the hook. Control of the latch is provided by an integral lug which engages in the recess of the slider-positioned along side the needle. Alternatively, the latch is provided with two lugs which are controlled by respective central-faces of an auxiliary sinker.

19 Claims, 8 Drawing Sheets

LATCH NEEDLE

BACKGROUND OF THE INVENTION

The present invention relates to an improved latch needle for a knitting machine.

By operating on the needle butt, cams position the needle at the required height for knitting, tucking, welting and so on.

The latch spoon is pivotally mounted to the shank for movement between two limiting positions which are angularly spaced approximately 150° apart. In the first position the latch spoon covers the point of the hook and in the second position the latch spoon rests against the shank in generally parallel relationship with the shank.

The latch needle is self-actuating since the opening and closing of the hook is accomplished through pressure of a loop upon the latch as the needle rises and falls relative to the loop.

The latch needle was invented in 1849 and enabled simple knitting machines to be built which were capable of high speed.

Latch needles have a wide variety of applications such as the knitting of socks and fine gauge hosiery, underwear and outerwear knitted on circular and flat machines, lace knitted on straight bar machines as well as narrow fabrics, ribbons, tapes and so on.

The success of the latch needle has been largely due to the simplicity of the loop forming action supported by improvements in precision engineering and the enormous resources which have gone into the development of needle technology.

The main disadvantages of latch needles currently in use are:

1. The extent of the movement needed to swing the latch through approximately 150° in clearing a newly formed loop off the end of the latch slows the rate of operation obtainable.
2. When the needle moves upwards and the latch opens to clear a newly formed loop, the shape of the needle and latch, together with the upward movement, cause the knitted loop to rise up with the needle. Therefore a holding down sinker is necessary to restrain the previously knitted loop from rising up with the needle and latch.
3. When the latch closes on to the point of the hook at high speed there can be a problem of impact damage which eventually causes fracture of the hook.
4. Since the loop controls the opening and closing of the latch, an empty needle requires an additional mechanism to open the latch in situations such as the commencement of a new garment or when a loop is transferred to an adjacent needle.

The latch is also uncontrolled when the needle rises to clear the "old" loop off the end of the latch, requiring a latch guard which obscures vision and prevents easy access for yam threading and general attention. Latch guards and fixing brackets around the needle cylinder of a circular knitting machine provides points for the accumulation of lint and dust which is detrimental to efficiency.

Attempts have been made previously to restrict the angle through which a latch pivots. GB 1160832 represents a typical earlier approach in that the latch is caused to pivot by an amount sufficient to bridge the gap between the point of the hook and the inside of the neck of the needle so that the hook is closed from the inside instead of being closed from the outside.

GB 1416291 is another patent disclosing latch movement between two end positions in the first of which the latch is in contact, at its free end, with the inner surface of the hook to close the hook and in the second of which the latch rests against a stop provided on the shank of the needle.

In the prior art discussed above, the hook closing action is from the needle shank towards the hook. Hence, when the needle is in use, if a new yarn is not located securely within the upper part of the hook, the in-to-out action by the latch tends to push the yarn outside the hook. Further, on circular knitting machines, the placing of new yarn in to the hook would require a loop forming sinker which would tend to reduce the productive capacity overall.

SUMMARY OF THE INVENTION

An object of the present invention is to provide an improved latch needle which aims to overcome these disadvantages.

According to the broadest aspect of the present invention there is provided a latch needle having a hook, a stem and a latch, the hook and the latch being movable one relative to the other between two positions in the first of which the latch is located within the hook and in the second of which the latch is located external of the hook and means fur creating relative movement between the hook and the latch.

In a preferred embodiment of the invention the hook and stem are fixed, the latch being movable relative thereto. In the preferred embodiment also the latch is pivoted to the stem such that the tip of the latch can press the tip of the hook to oscillate, in an arc, between positions internal and external of the tip of the hook The tip of the latch spoon may be notched to permit the latch to pass either side of the point of the hook. One or more cavities may be provided in the stem and/or hook to receive the notched spoon. Alternatively, the lip of the latch can pass the tip of the hook in an inter-fitting tongued relationship, preferably with overlapping of the tips of the hooks and latch as viewed in one elevation and clearance between the hook and latch as viewed in a second elevation.

In the preferred embodiment of the invention the latch is moved relative to the hook by means of a lug formed on one side of the latch. Preferably the lug is held in the recess of a slider which is positioned along side the needle. Axial movement of the slider relative to the needle causes radial movement of the lug, and hence the latch. Conveniently, butts, provided on the needle and slider engage in associated cam tracks to control the positions of the slider and needle. Alternatively, the lug itself may be held in a cam track.

In another embodiment of the invention, the latch is moved relative to the hook by means of lugs formed on either side of the latch. An auxiliary sinker is provided with control faces which act on the lugs. Alternatively the latch may be moved electromagnetically or in any other convenient manner.

Whichever way the latch is moved, the extent of its arcuate movement is approximately 40 degrees.

During knitting, yarns are subjected to various stresses and strains which can cause them to slip out of the confines of a hook. An important feature of conventional latch needles is the ability of the latch to secure newly fed yarn into the hook and retain it there, this feature being maintained in the latch needle of the invention. In this respect the closing of the hook from outside to inside is an important feature since the open latch guides yam into the hook, further rotation of the latch retaining the yam in the hook.

BRIEF DESCRIPTION OF THE DRAWINGS

The invention will now be described further by way of example with reference to the accompanying drawings in which.

DETAILED DESCRIPTION OF THE PREFERRED EMBODIMENT

Figure 1:
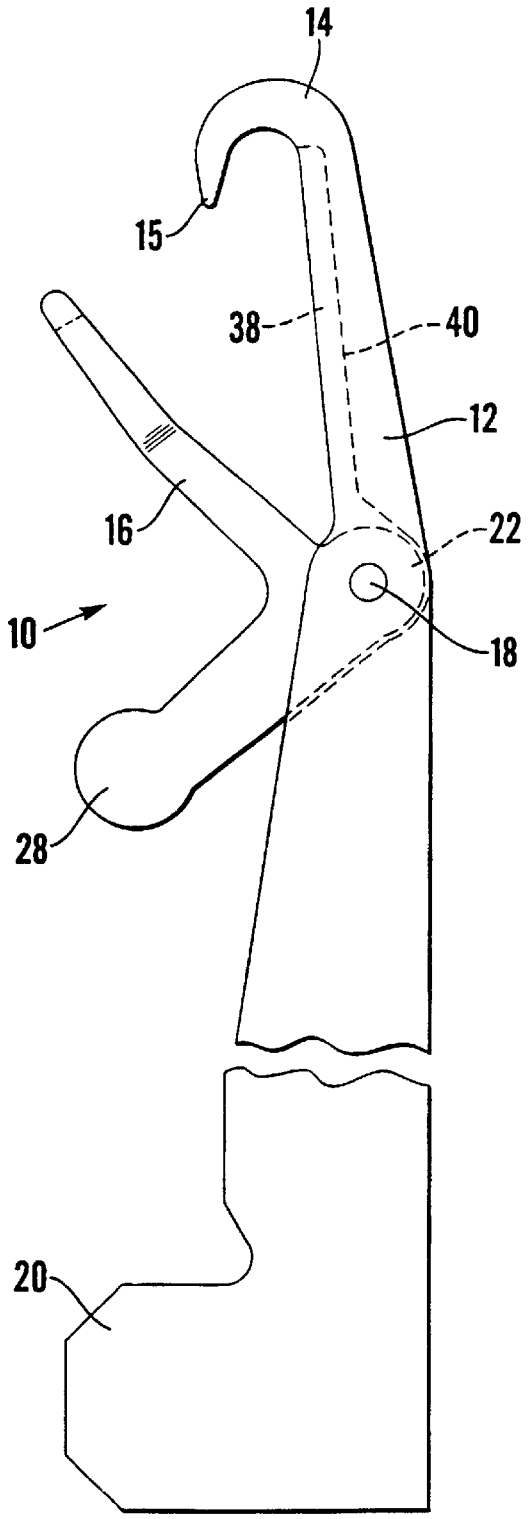
FIG. 1 shows a side elevation of a latch needle in accordance with a first embodiment of the invention.
Figure 2:
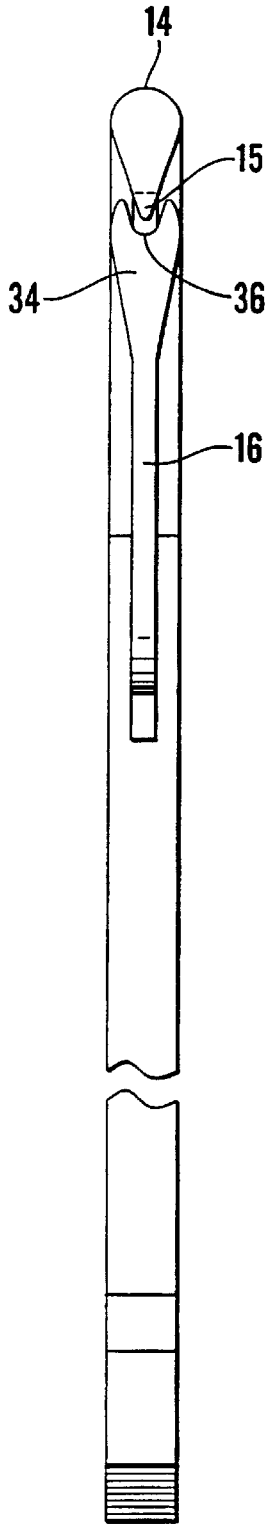
FIG. 2 is a front elevation of the latch needle shown in FIG. 1.

Referring firstly to FIGS. 1 and 2, a latch needle, generally indicated at 10, includes a needle stem 12 and a hook 14 formed integrally with the needle stem 12, the hook terminating at a point 15. A latch 16 is pivotally mounted to the needle stem 12 about a mounting including a pivot 18.

Figure 3:
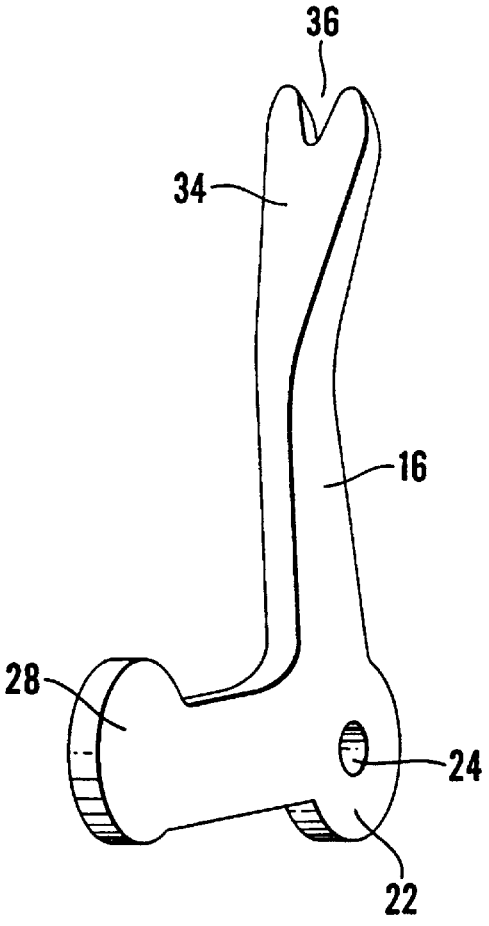
FIG. 3 shows an isometric view of the latch used in the latch needle of FIGS. 1 and 2.
Figure 4:
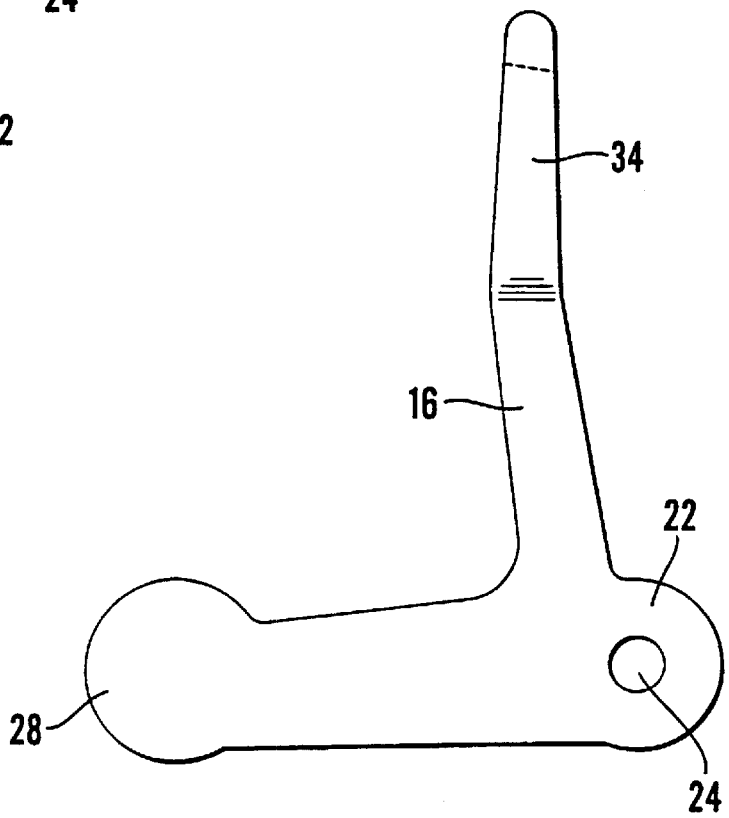
FIG. 4 is a side elevation of the latch of FIG. 3.

The latch 16 is shown in greater detail in FIGS. 3 and 4. The latch extends from a generally circular mounting 22, provided with a hole 24, by means of which the latch 16 is mounted for rotation on a cooperating mounting on the needle stem 12. A control lug 28 also extends from the mounting 22, rotational movement of which about the pivot 24 controls the rotational position of the latch 16. The latch 16 and control lug 28 are positioned generally perpendicular to one another and are integrally formed with the mounting 22.

As can best be seen from FIG. 2, a spoon 34 is formed at the end of the latch 16 and incorporates at its tip a notch 36. The notch 36 and the point 15 of the hook 14 are dimensioned to allow the point 15 to pass through the notch 36, thereby permitting the latch 16 to move in an arc between a position external of the hook 14 (as in FIG. 1), and a position internal of the hook 14 (as in FIG. 6).

The needle stem 12 is formed with a slot 38, in which the mounting 22 is received and pivotally mounted. The outline of the slot is indicated by dotted line 40 in FIG. 1 and its shape corresponds to the shape of the mounting 22 and the latch 16. When the latch 16 is in a position internal of the hook 14 (see FIG. 6), the top of the spoon 34 is accommodated into the needle stem 12.

The needle stem 12 is also formed with an integral butt 20, at its extreme end away from the hook 14, by means of which the axial movement of the latch needle 10 is controlled in known manner.

Figure 5:
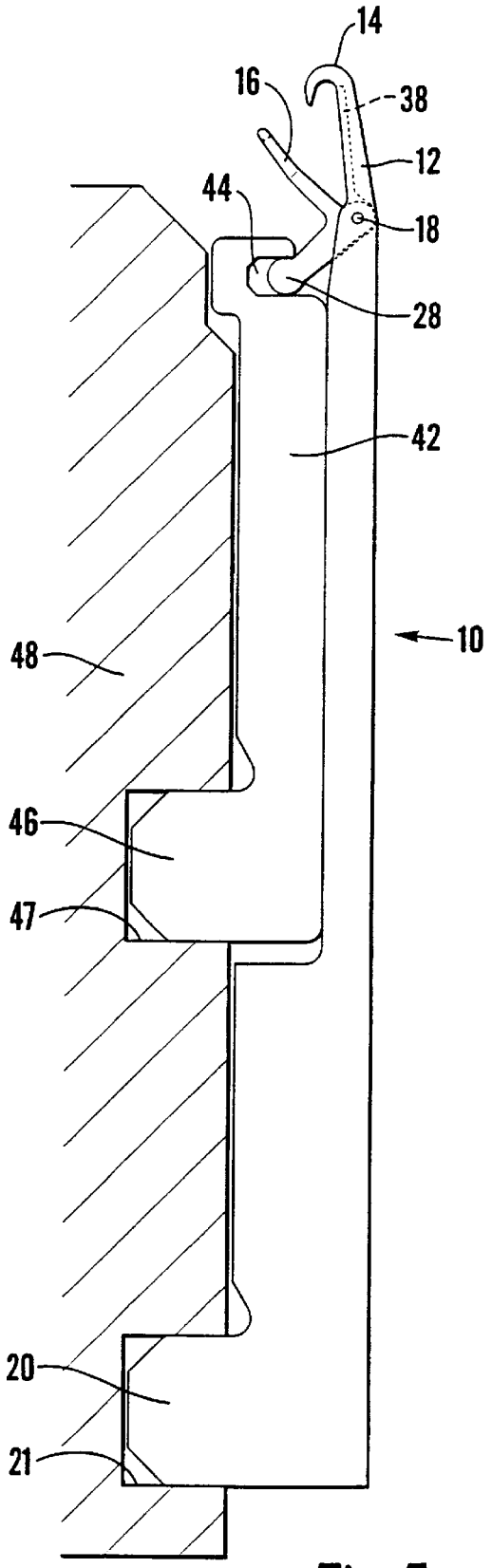
FIG. 5 is a side elevation of the latch needle shown in FIGS. 1 and 4, with a slider and associated cam tracks for the needle and slider.

Referring now to FIG. 5, the latch needle 10 is slidably mounted in a trick or groove of the needle cylinder of a knitting machine (not shown). A slider 42 is also slidably mounted in the same trick or groove alongside the latch needle 10, and is provided with a recess 44 which receives the control lug 28 of the latch 16. Relative axial movement between the slider 42 and the latch stem 12 causes the walls of recess 44 to act on the control lug 28, thereby causing rotation of the latch 16 about the pivot 18 between an open latch position as illustrated in FIG. 5, in which the latch 16 is external of the hook 14, and a clearing position in which the latch 16 is located in the slot 38 of the needle stem 12.

A butt 46 integrally formed with the slider 42 at its extreme end away from the recess 44 controls axial movement of the slider 42. The butts 20, 46 of the latch needle 10 and slider 42 respectively, are guided in respective cam tracks 21, 47, provided in a cam block 48.

Figure 6:
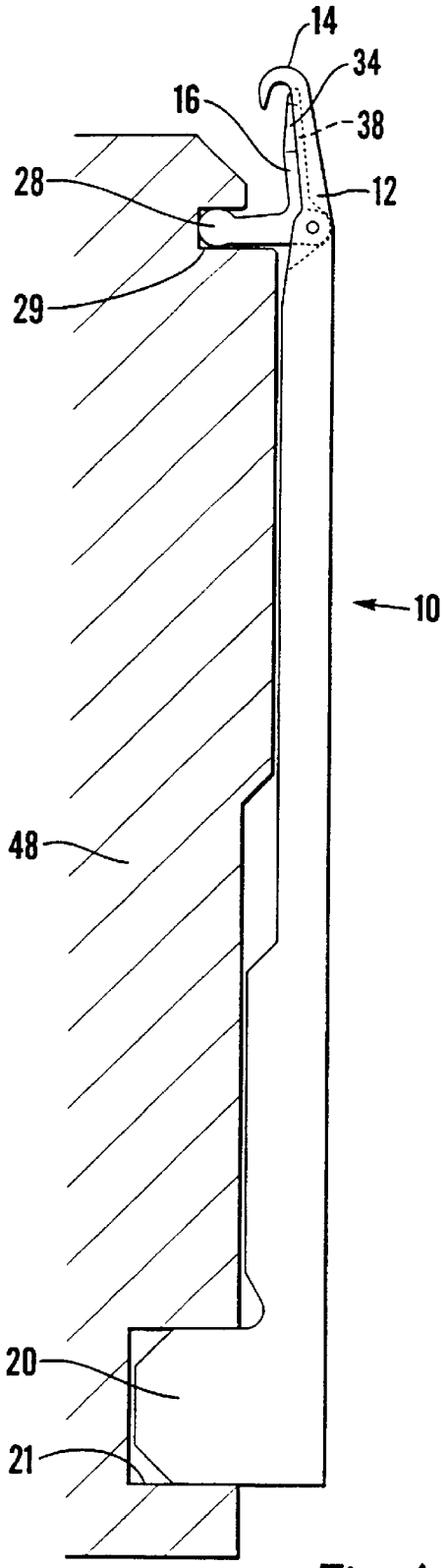
FIG. 6 is a side elevation of an alternative arrangement of the latch needle shown in FIGS. 1 to 4, without a slider and associated cam track.

In an alternative arrangement shown in FIG. 6 the control lug 28 is received directly in a cam track 29, without the need of the slider 42. Although this arrangement is advantageous in that it reduces the number of components, access to the knitting area is restricted by the proximity of the cam block 48.

Figure 7:
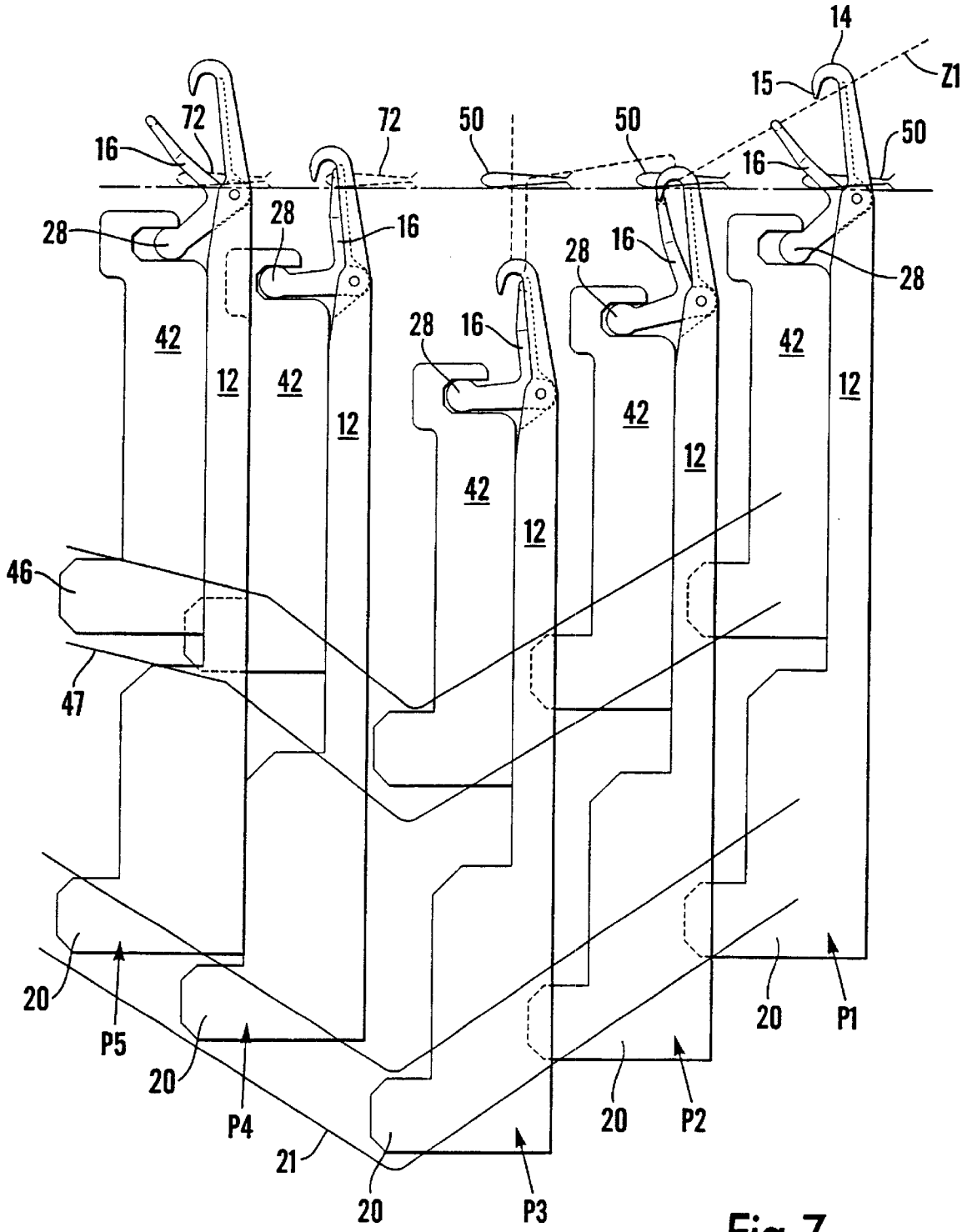
FIG. 7 illustrates a knitting sequence using the latch needle of FIGS. 1 to 4, with a slider, as shown in FIG. 5.

Referring now to FIG. 7, a knitting sequence is shown extending over five latch needles designated P1, P2, P3, P4, and P5. Each needle is capable of reciprocation within its respective trick or groove as controlled by its butt 20 in the cam track 21 in known manner. The latches 16 of the needles are correspondingly moveable to their required position by means of their respective lugs 28, sliders 42, butts 46 and cam track 47, all as previously described with respect to FIG. 5.

Needle P1 is at the top of its stroke having risen to its full height in its trick or groove. This is sometimes referred to as the cleared position. The latch 16 is held fully open by the slider 42, that is, external of the hook 14 in order to receive a yarn, Z1 (see dotted line) from a yarn feeder (not shown). The yam Z1 must be fed into the gap between the point 15 of hook 14 and the latch 16. A previously knitted loop, or "old loop" 50 is retained on the latch 16, whereby the "old loop" is held away from the hook 14 and needle stem 12. The angular position of the latch 16, sloping away from the needle stem 12, in combination with the movement of the needle through its cycle is such that the "old loop" 50 tends not to ride up the latch 16.

In the position illustrated by needle P2, the needle has started to move downwards from the position of needle P1 and the latch 16 has shut, thereby retaining the yarn Z1 in the hook 14 of the needle. Due to the downward movement of the needle the "old loop" 50 now occupies a position around the closed hook 14 of the needle. Hence, the yam Z1 is being drawn through the "old loop" 50. It can be seen from FIG. 7 that cam track 21 has a steeper gradient than earn track 47 at this point in the sequence, thus causing an upward movement of the slider, relative to the needle stem 12. Therefore, the latch 16 will move towards the needle stem 12, passing through the closed position as shown by needle P2.

Needle P3 is illustrated at the lowest pont in the knitting sequence. The needle has descended through the "old loop" 50, thus creating a new loop 72, and casting the "old loop" 50 over the head of the needle. This is sometimes referred to as the cast-off or knock over position. The latch 16 is partially located in the slot 38, and is now at the limit of its movement towards the needle stem 12.

It will be understood that at this point in the knitting cycle, with a conventional needle latch, the latch could not have passed beyond the point of the hook towards the needle stem, and would have moved therefore in the opposite direction, that is, away from the hook.

In the position illustrated by needle P4, the needle has started to move upwards with the effect of relatively moving the newly formed loop 72 down the needle stem 12, along the latch. Since the upward gradients of the cam tracks 21, 27 between the needle positions P3 and P4 are identical, the position of latch 16 remains unchanged from the position of the latch 16 of needle P3.

Finally, needle P5 has returned to the same position as needle P1 . The latch 16 is again fully open, having moved through its complete arc of movement between needle positions P4 and P5. The upward gradient of cam track 47 between needles P4 and PS is much flatter than the gradient of cam track 21. This causes downward movement of the slider 42 relative to the needle stem 12, and therefore opens the latch. The overall upward movement of the needle, together with the inclination of the latch 16 away from the needle stem 12, tends to retain the newly formed loop 72 on the latch 16, thus relinquishing the need for a holding down sinker. Furthermore, the newly formed loop is under a limited amount of tension which helps to retain it on the latch 16.

Figure 8:
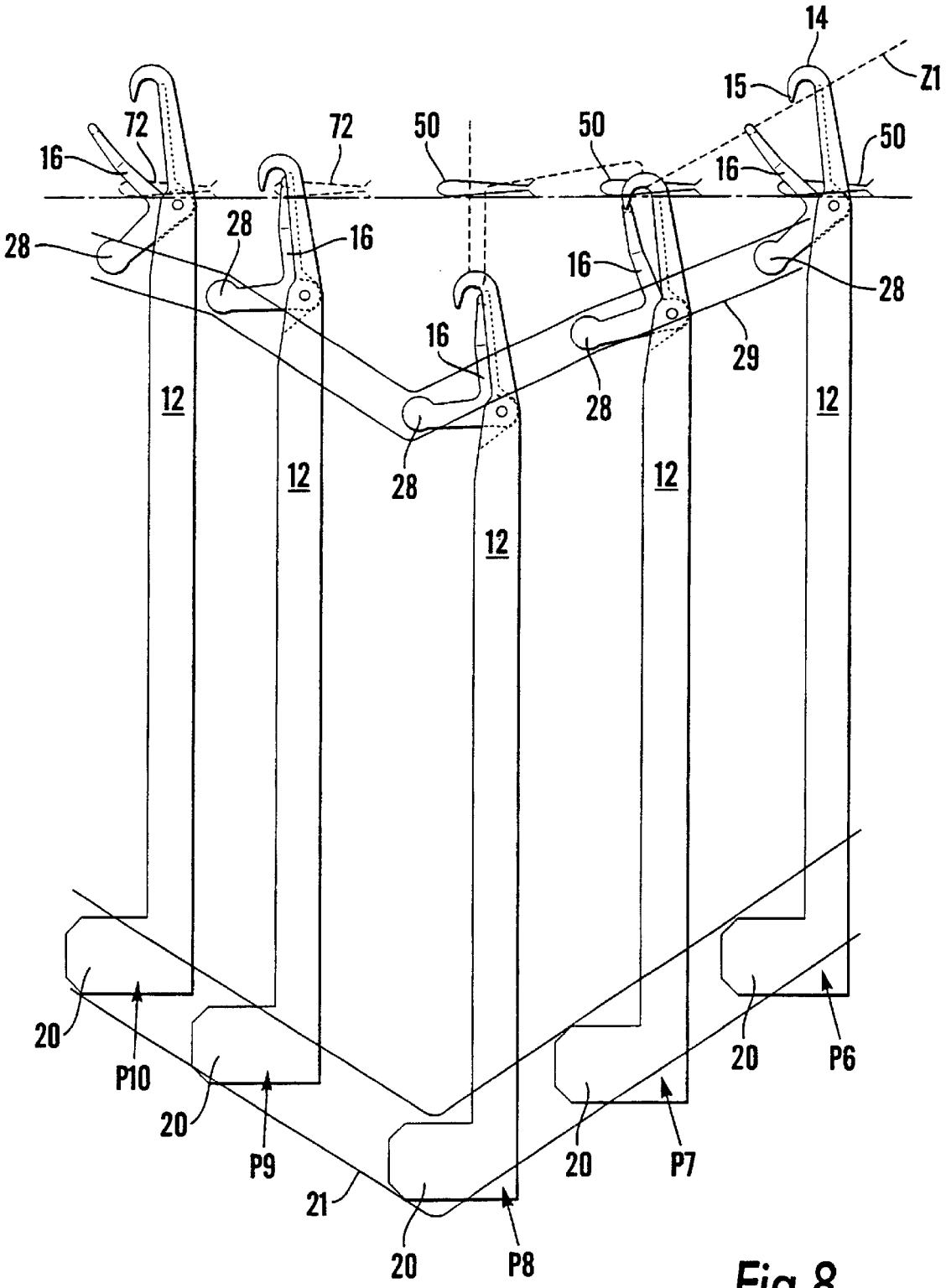
FIG. 8 illustrates a knitting sequence using the latch needle of FIGS. 1 to 4, without a slider, as shown in FIG. 6.

In the knitting sequence as illustrated in FIG. 8, the positions of the needles P6, P7, P8, P9 and P10 correspond to the positions of respective needles P1, P2, P3, P4 and P5 as shown in FIG. 7. The axial movement of the needle stems 12 in each sequence is controlled in exactly the same way, and therefore the gradients of cam track 21 in each knitting sequence are identical. The gradients of cam track 47 (FIG. 7) and cam track 29 (FIG. 8) are also identical, because even though there is no slider 42 in the FIG. 8 arrangement, the position of a latch 16 in relation to its associated needle stem 12 remains the same for a given needle at a given position in the knitting sequence. The knitting sequence is therefore similar to that described with reference to FIG. 7 but without reference to the slider 42.

Another embodiment of the invention will now be described with reference to FIGS. 9 to 16.

Figure 9:
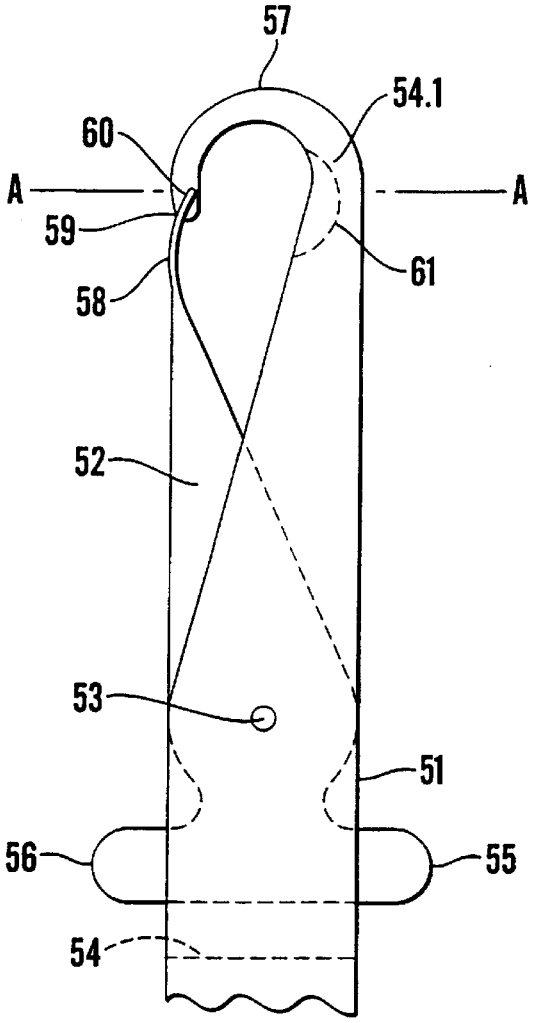
FIG. 9 shows a side elevation of part of a latch needle according to an alternative embodiment of the invention.
Figure 10:
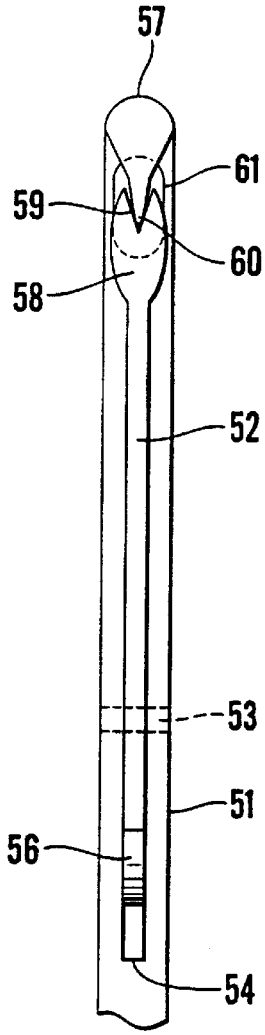
FIG. 10 is a front elevation of the latch needle of FIG. 9.

FIGS. 9 and 10 illustrate a needle stem 51 which houses a latch 52 within a slot extending from position 54 to position 54.1. Control lugs 55 and 56 are located on the lower end of the latch 52 and protrude from either side of the slot. Forces applied to these lugs will cause the latch to oscillate about the latch pivot 53. The upper end of the latch 52 is formed into a curved spoon 58 in the tip of which a notch 59 is provided which permits the latch to move in arc on either side of the point 60 of hook 57. An indentation or cavity 61 formed in the inner periphery of the hook receive the tips of spoon 58. Thus, a force applied to the lug 56 will rotate the latch anti-clockwise, whereas a force applied to the lug 55 will rotate the latch clockwise so that the spoon 58 moves within the hook 57 and, at the limit of its movement, lies in the indentation 61.

Figure 11:
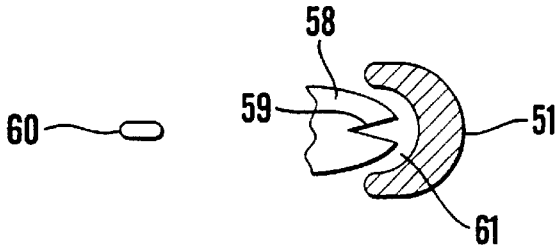
FIG. 11 is a cross-section through the line A—A of FIG. 10, when the needle is at its lowest point of movement in a given knitting cycle.
Figure 14:
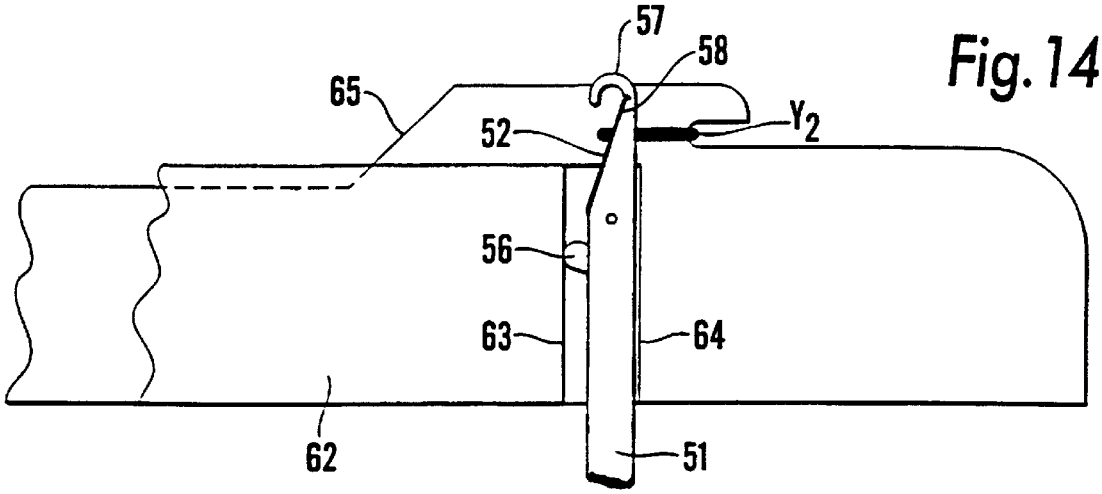

FIG. 11 which shows a section through the needle at the line A—A illustrates the position when the spoon of the latch is located in the indentation 61, (see also FIG. 14).

Figure 12:
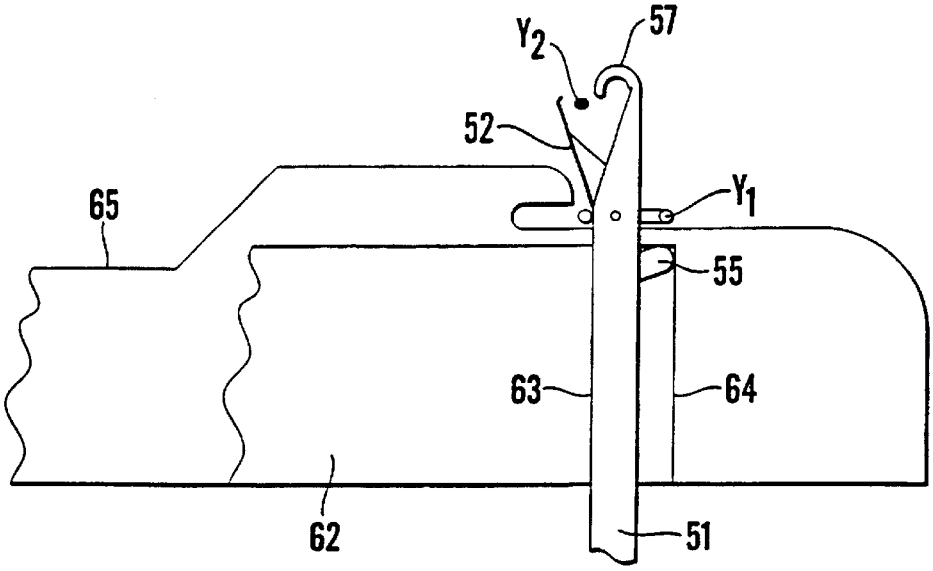
FIGS. 12, 13 and 14 illustrate the loop forming action of the latch needle of FIGS. 9 and 10.

FIG. 12 shows the start of a loop forming action with the needle at the highest position and the latch 52 in the open position to receive new yarn Y2. The latch 52 is in a fully open position which represents one limit of its arcuate movement. The previously knitted loop is located around the stem of the needle at the pivot point, an auxiliary sinker 62 with control faces 63 and 64 have depressed control lug 56 into the slot. Numeral 65 designates a conventional sinker.

Figure 13:
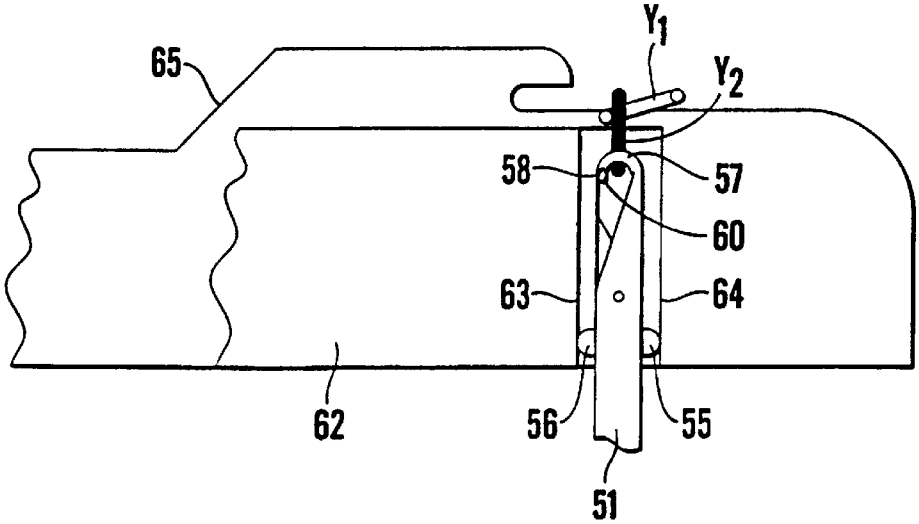

FIG. 13 shows the needle at the lowest position having formed loop Y2 and cast off the previous loop Y1 over the hook 57, the spoon 58 having shielded the point 60 of hook 57 to enable the loop Y1 to pass over the tip. The auxiliary sinker 62 has positioned the lugs 55 and 56 equally on either side of stem 51 to position the latch in the loop forming, knock over position.

FIG. 14 indicates how the new loop Y2 is entered by the latch 52, the spoon 58 having been located in the indentation 61 by the action of the auxiliary sinker depressing the lug 55 into the slot. This position of the latch 52 represents the second limit of its arcuate movement. The angular extend between the two limiting positions approximately 40 degrees.

In will be understood that at this point in the knitting cycle, with a conventional needle latch, the latch has to move away from the hook in a much greater arc of approximately 150° in order to position the newly formed loop on the side of the latch away from the hook. The knitted loop is held down by sinkers, while upward movement of the needle causes the loop to clear the fully open latch, thus moving the lop off the latch onto the needle stem. When the needle is in its highest position, the needle receives yarn from a yarn carrier. The following downward movement of the needle thereby causes the loop to engage the other side of the latch, causing it to close. The movement of the needle is therefore necessarily much greater than the movement required of a needle of the invention.

Figure 15:
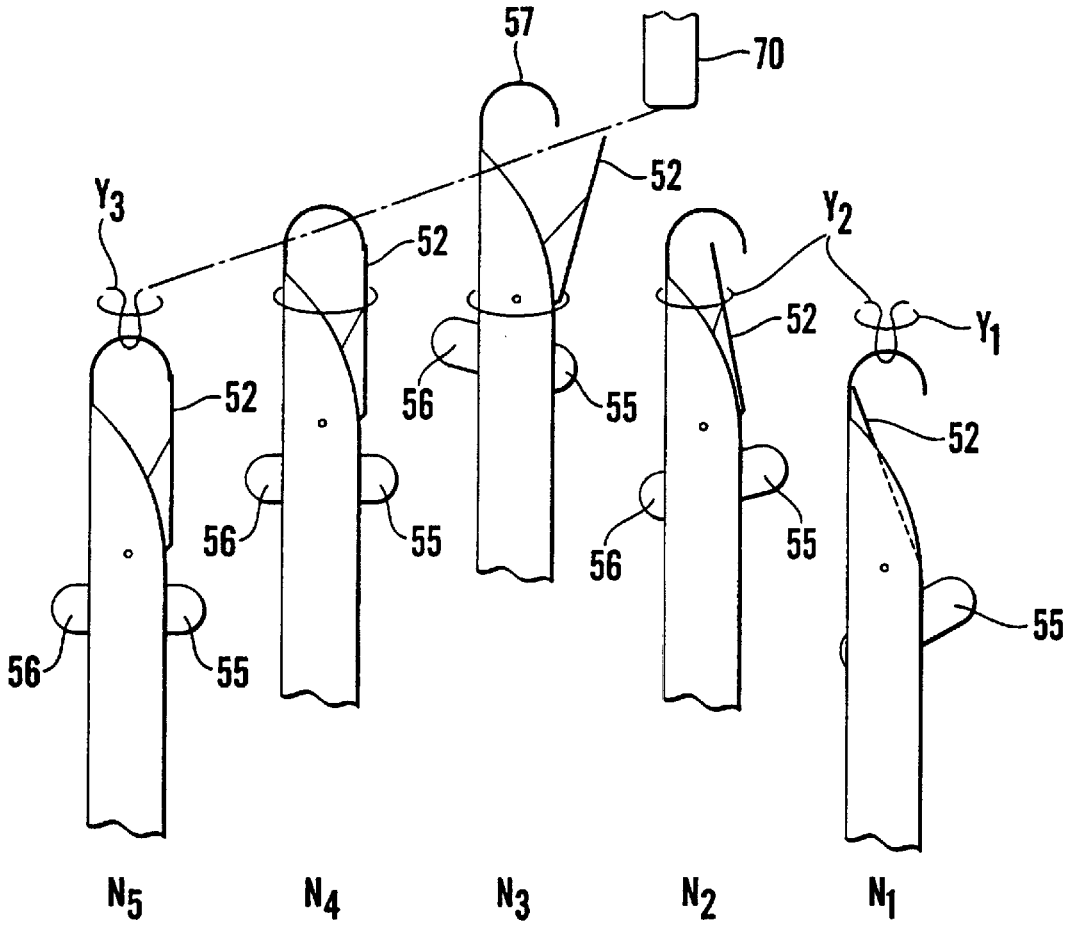
FIG. 15 illustrates a knitting sequence using the latch needle of FIGS. 9 and 10.
Figure 16:
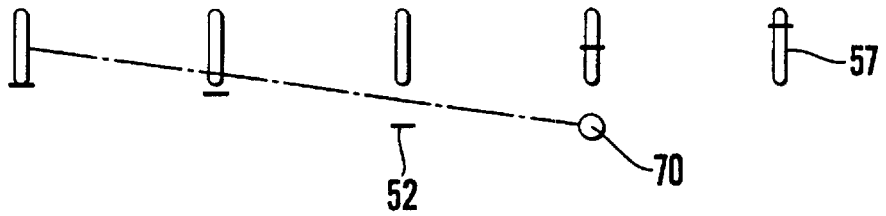
FIG. 16 is a plan view of the sequence shown in FIG. 15.

The knitting sequence shown in FIGS. 15 and 16 extends over five needles designated N1, N2, N3, N4 and N5. The needles are illustrated at different heights being movable to the required heights by means of their respective butts which enable each needle to be reciprocated within its respective trick or groove in known manner.

Needle N1 is in the lowermost position having drawn yarn loop Y2 through a previously knitted loop Y1. Lug 56 is pressed into the stem of the needle to rotate the latch 52 anticlockwise, as viewed, into one of its limited positions within the needle hook. Hence, the hook of the needle is free to receive a newly formed loop Y2 as the needle rises.

In the next illustrated position the needle N2 has half risen, the latch 52 having entered the loop Y2. The latch 52 has rotated in a clockwise direction under control of the lugs 55, 56.

In the following position the needle N3 has risen to its full height. The latch 52 is held open, by depression of the lug 55, to receive yarn Y3 from a yarn feeder 70. Referring to FIG. 16, it will be seen that the yarn Y3 must be fed into the gap between the hook 57 and the latch 52 which gap lies outside of the hook.

The application of further pressure to the lug 56 closes the latch onto the hook so that the yarn Y3 is drawn securely into the hook as can be seen at N4.

In the final position, yarn loop Y3 has been drawn through yarn loop Y2. In this position both lugs 55 and 56 extend equally from the needle shank since no pressure is applied to either of them.

With a conventional latch needle, once the needles have risen to their clearing position, that is their highest positions within their respective needle tricks, their latches are uncontrolled and are thus free to "flop". Hence, a latch guard is needed to hold the latches open. In the present invention however no latch guard is needed since the position of the latch is always under the control of either a single lug guided directly or indirectly by a cam track, or by lugs controlled by control faces of an auxiliary sinker.

Whereas in the above-described embodiments of the invention the needle hook is integrally formed with the needle stem and the latch moves relative to the hook, it is envisaged that the latch could be integrally formed with the stem and the hook be movable relative thereto.

What is claimed is:

1. A latch needle having a hook, a stem and a latch, characterised in that the latch oscillatingly moves relative to the hook between a first position and a second position, the first position located within the hook and the second position located external of the hook, said latch needle having means for creating oscillating movement of the latch relative to the hook.

2. A latch needle according to claim 1 characterised in that the hook and stem are fixed and the latch is movable relative thereto.

3. A latch needle according to claim 2 characterised in that the latch is pivoted to the stem.

4. A latch needle having a hook, a stem and a latch, characterized in that the hook and latch are movable relative to each other between a first and second position, wherein the first position the latch is located within the hook and the second position the latch is located external of the hook, said latch needle having means for creating relative movement between the hook and the latch, and wherein the hook and stem are fixed and the latch is movable relative thereto, the latch having a tip formed into a latch spoon which is notched to permit the latch spoon to pass either side of the point of the hook for oscillation in an arc between the first and second positions.

5. A latch needle according to claim 4 characterised in that one or more cavities are provided in at least one of the stem and hook to receive the notched spoon.

6. A latch needle having a hook, a stem and a latch, characterized in that the hook and latch are movable relative to each other between a first and second position, wherein the first position the latch is located within the hook and the second position the latch is located external of the hook, said latch needle having means for creating relative movement between the hook and the latch, wherein the latch is moved relative to the hook by means of a lug formed on one side of the latch.

7. A latch needle according to claim 6 characterised in that the latch and lug are positioned generally perpendicular to one another.

8. A latch needle according to claim 6 characterised in that the lug is held in the recess of a slider which is positioned alongside the needle.

9. A latch needle according to claim 6 characterised in that a slider is positioned alongside the latch needle, and the axial movement of the slider relative to the latch needle causes radial movement of the lug and hence the latch.

10. A latch needle according to claim 1 characterised in that a butt is provided on the needle shank which is guided in a cam track for controlling the needle height.

11. A latch needle according to claim 8 in which a butt is provided on the slider which is guided in a cam track for controlling the height of the slider and hence the angular position of the needle latch.

12. A latch needle according to claim 6 characterised in that the lug is received in a cam track for controlling radial movement of the lug and hence the latch.

13. A latch needle having a hook, a stem and a latch, characterized in that the hook and latch are movable relative to each other between a first and second position, wherein the first position the latch is located within the hook and the second position the latch is located external of the hook, said latch needle having means for creating relative movement between the hook and the latch, wherein the latch is moved relative to the hook by means of lugs formed on either side of the latch.

14. A latch needle according to claim 13 characterised in that when forces are applied to the lugs in directions perpendicular to the needle to cause rotation of the latch.

15. A latch needle according to claim 13 characterised in that control faces of an auxiliary sinker act on lugs respectively to cause rotation of the latch.

16. A latch needle according to claim 1 characterised in that the latch moves in an arcuate path substantially 40 degrees.

17. A latch needle according to claim 5 characterised in that the upper end of the latch is formed as a curved spoon for receipt in the cavity.

18. A knitting machine whenever incorporation at least one latch needle according to claim 1.

19. A latch needle according to claim 1, wherein the latch needle has means for creating oscillating movement of the latch relative to the hook between the first and second positions.

* * * * *